United States Patent [19]

Morgan, IV

[11] Patent Number: 5,031,776

[45] Date of Patent: Jul. 16, 1991

[54] PALLET CONTAINER HAVING ENTRYWAYS FOR FORKLIFT PRONGS ON EACH SIDE THEREOF

[76] Inventor: Robert L. Morgan, IV, 12450 East 'O' Ave., Climax, Mich. 49034

[21] Appl. No.: 416,875

[22] Filed: Oct. 4, 1989

[51] Int. Cl.[5] ..... B65D 19/18

[52] U.S. Cl. ..... 206/600; 108/55.3; 108/56.1; 108/57.1; 108/901; 206/598; 220/1.5; 220/4.28

[58] Field of Search ..... 220/1.5, 4 F; 206/386, 206/596, 597, 600, 595, 599, 598; 108/55.1, 56.1, 57.1, 901, 902, 55.3, 56.3

[56] References Cited

U.S. PATENT DOCUMENTS

| | | | |
|---|---|---|---|
| 685,938 | 11/1901 | Page | 206/587 X |
| 2,210,162 | 8/1940 | Boeye | 206/588 X |
| 2,503,562 | 4/1950 | Porter | 220/1.5 X |
| 2,664,219 | 12/1953 | Schmidt | 206/596 X |
| 3,045,889 | 7/1962 | Whiton | 206/599 X |
| 3,246,828 | 4/1966 | Branscum et al. | 220/4 F |
| 3,477,631 | 11/1969 | Dunlap . | |
| 3,540,613 | 11/1970 | Hudson, Jr. | 220/4 F X |
| 3,776,435 | 12/1973 | Smith . | |
| 3,828,965 | 8/1974 | Yarbrough . | |
| 3,985,258 | 10/1976 | Quigley et al. | 220/4 F |
| 3,993,211 | 11/1976 | Astle | 220/1.5 |
| 4,173,287 | 11/1979 | Kumakawa | 206/600 X |
| 4,435,463 | 3/1984 | Roellchen . | |
| 4,492,153 | 1/1985 | Grabowski | 206/600 X |
| 4,614,277 | 9/1986 | Fourie . | |
| 4,730,732 | 3/1988 | Wagonseller . | |
| 4,785,957 | 11/1988 | Beek et al. | 220/4 F |

FOREIGN PATENT DOCUMENTS

| | | | |
|---|---|---|---|
| 2436080 | 5/1980 | France | 206/386 |
| 2459760 | 2/1981 | France | 206/597 |
| 2179629 | 3/1987 | United Kingdom | 206/600 |

*Primary Examiner*—Bryon P. Gehman

*Attorney, Agent, or Firm*—Gordon W. Hueschen

[57] ABSTRACT

A knockdown pallet container formed of molded or extruded pallet members, comprising a bottom-forming pallet member, a top pallet member, and side pallet members, a combination of the bottom, side, and top pallet members providing a pallet container of rectangular configuration, at least the bottom-forming member having entryways for the prongs of a lift truck, the rectangular pallet container being banded together by external strapping which holds continuous female and male configurations at respective sides of the various pallet members in mating engagement with each other where they meet to form corners of the container, is disclosed, as well as various internal support members which matingly engage with interior surfaces of the various pallet members.

50 Claims, 2 Drawing Sheets

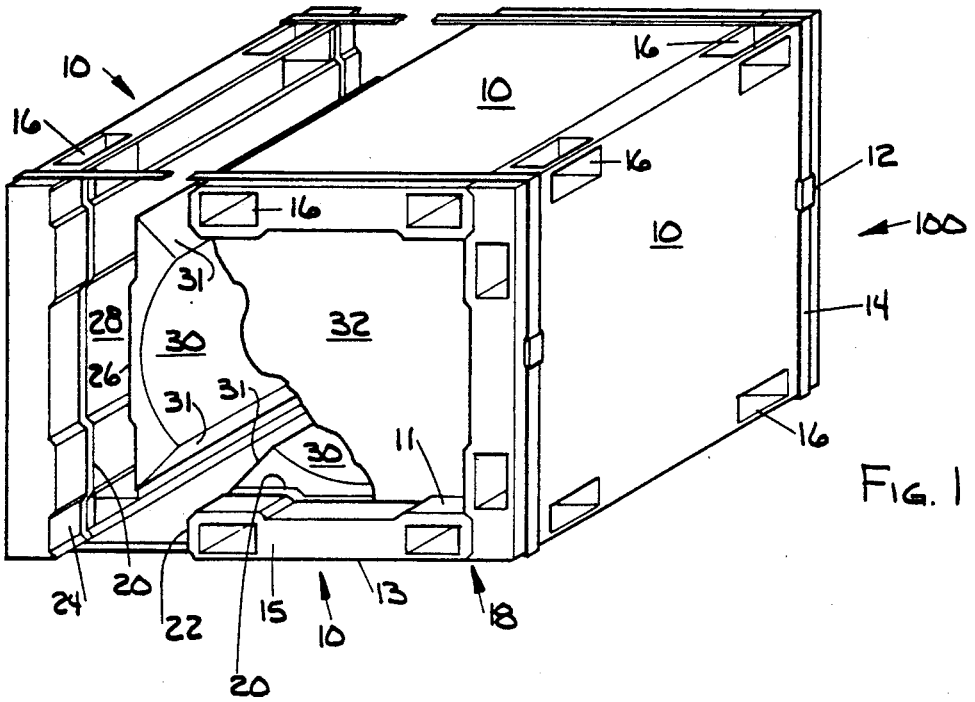
FIG. 1
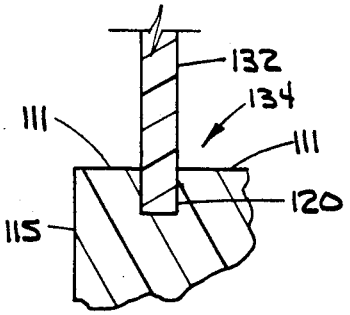
FIG. 3
FIG. 2
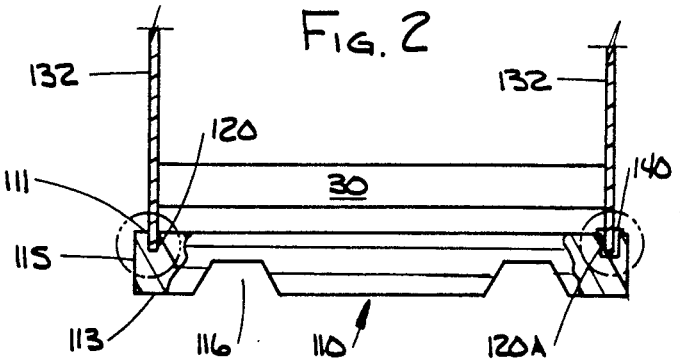
FIG. 5
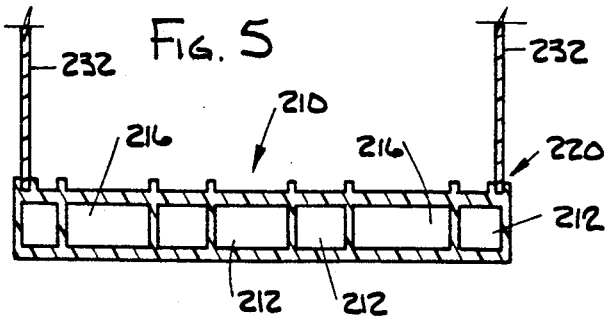
FIG. 4
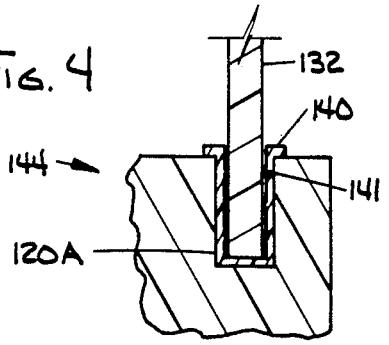

PALLET CONTAINER HAVING ENTRYWAYS FOR FORKLIFT PRONGS ON EACH SIDE THEREOF

BACKGROUND OF THE INVENTION

1. Field of Invention

The field of the invention is shipping containers, more particularly, containers having a pallet feature combined therewith.

According to American National Standard "Pallet Definitions and Terminology", ANSI MH1.1.2-1978, published by The American Society of Mechanical Engineers, the pallet container (or container pallet) of the present invention may in some embodiments also be referred to as a "single deck pallet with truck openings", or as a "non-reversible flush deck with four way entry" pallet, or, when using load-conforming inserts, also as a "special purpose pallet" but, especially when four pallet members and two end members are employed to provide a six-sided shipping container, it is more precisely referred to according to the standard, as a "pallet container" or "container pallet".

2. Prior Art

Numerous pallets of innumerable types, sizes, and configurations have been known in the art. However, few are what can properly be referred to, according to the standard, as a "pallet container" or "container pallet", and none of the pallets known to be available in the prior art have the advantages and features of the pallet container of the present invention.

Searches conducted in USPTO Classes 206, Subclasses 316, 320, 386, 389, 453, 577, 592, 593, 600, and 621, and in Class 217, Subclasses 12R and 69, and in Class 220, Subclasses 1.5 and 4F, as well as in Class 108, Subclasses 51.1, 55.1, 55.3, 56.1, 56.3, and 901, turned up only a few patents on shipping pallets or containers which can properly be referred to as "pallet containers". These are as follows: U.S. Pat. Nos. 3,477,631 Dunlap et al., 4,614,277 Fourie et al., 3,776,435 Smith, and 3,828,965 Yarbrough. Related U.S. Pat. Nos. 4,730,732 to Wagonseller and 4,435,463 to Roellchen also had some relevance. However, none of these patents disclose a pallet with a design feature which allows the pallet to be transformed into a container, and Wagonseller and Roellchen disclose only roll and cylindrical object-supporting devices for use in supporting shaped articles, but not particularly for use in close compatibility with a shipping container, much less a pallet container. Moreover, none of the patents turned up in the search disclosed the type of pallet container provided according to the present invention or any of numerous significant advantageous features thereof.

THE INVENTION IN GENERAL

The present invention, as already stated, relates to shipping containers and more particularly to containers having a pallet feature combined therewith, which can be referred to according to the universal standard as a "pallet container". The invention, in certain embodiments, comprises a special design feature which makes it a four-way entry pallet with a non-reversible deck. The pallet design is such that four (4) pallets or panels may be used to construct a pallet container or container pallet. If desired, end plates, walls, or caps may be employed as an integral part of the container to form a six (6) sided container or box. The resulting container or box will, in such case, totally enclose and protect the contents thereof. The pallet container may, moreover, include product-conformable or other inserts attached to the pallet decks to further support and protect the contents of the pallet container. The pallet container of the invention may be fully or partially disassembled at the shipping destination and the components thereof returned to the place of origin, insofar as it is a knock-down (KD) type of pallet container. Alternatively, and advantageously, the pallet comprising the bottom member of the pallet container may continue to serve as a supporting pallet for the contents of the pallet container upon reaching the shipping destination, while one or more of the other three (3) sides of the container, along with the end caps if desired, may be returned to the place of origin, whether or not the bottom load-supporting pallet member is to follow back to the place of origin. The pallet container of the invention may advantageously be structured to provide the ability for a four (4) way entry with fork trucks. Moreover, the units may conveniently be stacked for storage and transportation. A stacking aid with protrusions which engage reinforcing ribs, protrusions, or irregularities of the pallet exteriors is sometimes useful, although not essential, for preventing load shifting during transport. The pallet container of the invention may be produced from a wide variety of materials, e.g., cast or extruded or molded plastic, whether thermosetting or thermoplastic, or foamed plastic types. The unit can also be produced from metals, whether fabricated or extruded. Wood and fiber materials can also be molded together with proper binding agents, as known in the art, to provide strong but relatively light-weight pallet units. If desired, a stressskinned structure may be employed, using external backing sheets of wood, plywood, plastic, cardboard, fiberboard, paperboard, corrugated paperboard, or the like, as is usual in such fabricated construction. As extrusions, the pallet or panel members which, according to the invention, can be employed to produce a pallet container of the invention, may have either axis as major axis, each arrangement having some advantage. One axis can be chosen for the extruding machine direction when long pallets are desired for the shipment of long objects or when small profiles are required. The other direction may be selected as the major axis when objects of greater profile but minimum length are desired to be shipped. The present invention, in any event, provides a superior and advantageous alternative to any of the presently-available pallets or pallet containers, especially those where a site-fabricated container and pallets or skids are employed for shipping.

FURTHER DETAILS OF THE INVENTION

The exterior surfaces of the pallet container of the invention may have a "waffled", ribbed, or irregular surface pattern to prevent slippage or load shifting during transport, and the interior surfaces are advantageously provided with mating devices or points which aid in locating and fixing the load-conforming or other inserts. Locking keys, dovetails, and fasteners may be employed to secure inserts within the pallet containers of the invention. Adhesive securement is also a preferred securement means. Attachment devices may also be molded into the pallet deck or provided in the form of inserts for securement of loads using conventional slings and binders. When end plates, walls, or caps are employed, suitable end closure means and retainers may be incorporated into the design, for example, the end plates, walls, or caps may be fitted into grooves provided in the walls of the pallet container, with suitable means being provided for the insertion and removal thereof, for example, a suitable slot in one of the wall-forming pallet members, normally the top wall of the pallet container.

When manufactured as an extrusion of any type, having voids therein as is usual in the extrusion art, such voids may be foam filled with any suitable material, e.g., particulate filler or foam, for purposes of absorbing shock and providing additional strength to the structure.

Combinations of engineering materials may be employed in the manufacture of the pallet containers of the invention to yield a selected and desired weight and strength, as well as cosmetic properties.

The pallet containers of the invention are banded over the exterior thereof at final assembly, that is, secured together by strapping of metal or plastic, such as steel or Signode Dymax TM strapping, which may in some instances advantageously be countersunk, if desired.

In some embodiments, the pallet container of the invention comprises yieldable inserts which are configured for support of an article intended to be contained therein, which inserts may also conveniently serve as separators between various articles being shipped in a single pallet container of the invention.

Among the uses uniquely characterizing the pallet containers of the present invention are the following:

When employing conformable inserts, for the shipment of any object or objects, whether symmetrical or not.

In the shipment of liquids, employing a bladder for the liquid and suitable internal supports when required. Such pallet container is KD for return shipment.

For parts shipment, any single or multiple of the parts unit may be shipped into the production area in a pallet container of the invention, which may be used for turnaround and the shipment of finished goods out of the production area in the same pallet container.

For air freight, in cases of urgency, with the KD unit components to be returned by surface transportation.

Using an air bladder insert as a conformable insert, for the shipment of delicate goods which might otherwise be damaged during shipment without such type of support.

Employing one or more stacking trays in the pallet container of the invention makes them particularly adaptable for the shipment of fresh produce and other bulk items which are sensitive to packing. Shipment can be by intermodal means and, once again, the KD components of the pallet container of the invention may be conveniently returned by surface means. This type of arrangement is especially suitable for fresh market produce, raisins, and the like.

OBJECTS OF THE INVENTION

It is an object of the present invention to provide an improved pallet container and the various components thereof which are necessary to complete its assembly in various forms or embodiments. A particularly preferred object is to provide such a knockdown (KD) pallet container which is extruded or compression molded. It is a further object of the invention to avoid the disadvantages and shortcomings of the prior art in this area or field of pallet containers. It is another object of the invention to obtain such advantages over prior art pallet containers as are provided by the pallet containers of the present invention. Other objects of the invention will be apparent to one skilled in the art and still others will become obvious as the description proceeds.

SUMMARY OF THE INVENTION

The invention, then, inter alia, comprises the following, singly or in combination:

A knockdown pallet container formed of molded or extruded pallet members, comprising a bottom-forming pallet member, a top pallet member, and side pallet members, a combination of the bottom, side, and top pallet members providing a pallet container of rectangular configuration, at least the bottom-forming pallet member having entryways for the prongs of a lift truck, the rectangular pallet container being banded together by external strapping which holds engaging means at ends or sides of the various pallet members in mating engagement with each other where they meet to form corners of said container; such a pallet container wherein the sides of the pallet members are configured so as to provide complementary male and female engaging means; such a pallet container wherein the sides of the pallet members are configured so as to provide male and female interlocks; such a pallet container wherein the bottom-forming pallet member has entryways for the prongs of a lift truck at both its front and rear; such a pallet container wherein internal support means are provided for supporting a load interior of said pallet container; such a pallet container wherein the internal support means are provided with engaging means adapted to mate with complementary engaging means provided on pallets interior of the pallet container; such a pallet container wherein the engaging means comprises a male protuberance on the internal support means and a female depression on a surface of a pallet member interior of the container; such a pallet container wherein the internal support means is provided in the form of sections adapted to mate with each other at corners of the pallet container; such a pallet container wherein sections of the internal support means are adapted to lie against interior surfaces of the pallet container and to mate with each other at interior corners of the pallet container; such a pallet container wherein the internal support means are angled at edges adapted to mate at corners of the pallet container so as to provide mating abutment thereof at junctures thereof internal of said pallet container and at interior corners thereof; such a pallet container comprising end wall or divider means; such a pallet container comprising also means for securing said end wall or divider means with respect to a pallet member of said container; such a pallet container wherein said securing means comprises a slot in a pallet member of said container adapted to receive said wall or divider means; such a pallet container wherein said securing means also comprises adapter or socket means for securement of said end wall or divider means in said slot in said pallet member; such a pallet container wherein said internal support means comprises engagement means adapted to mate with engagement means provided in a pallet member against which it abuts, and complementary engagement means in said member; such a pallet container comprising also preformed internal support means adapted to protect a load being transported therein; such a pallet container comprising contoured external surfaces adapted to cooperate with similar external surfaces of abutting pallet containers of the same type, thereby to prevent excessive relative movement between abutting pallet containers during transportation thereof; such a pallet container comprising entryways for the entry of forklift prongs also in one or more of the side and top pallet members, thereby to permit entry of prongs of a forklift whether the pallet container is resting upon one member or another; such a pallet container wherein entryways for the entry of prongs of a forklift are provided on all four of the bottom, top, and side pallet members, thereby to allow entry of prongs of a forklift regardless of the member upon which said pallet container is resting; such a pallet container wherein the bottom-forming pallet member also comprises entryways for the insertion of prongs of a forklift therein from the side; such a pallet container wherein a plurality of the top, bottom, and side pallet members also comprise entryways for the insertion of prongs of a forklift from the side; such a pallet container wherein all of the bottom, top, and side pallet members comprise entryways for the entry of prongs of a forklift from the side; such a pallet container wherein internal support members abut interior surfaces of all four pallet members and all internal support members are angled at their edges for mating abutment at the corners of the container, thereby not only to provide abutment of said interior support members but also to add structural support at the corners of said container; such a pallet container comprising end walls at both the front and rear thereof; such a pallet container wherein said entryways are provided in the form of depressions in the external surface of a pallet member; such a pallet container wherein said entryways are provided in the form of suitable indentations in a molded external surface of a pallet member; such a pallet container wherein said entryways are provided in the form of apertures into the pallet member itself; such a pallet container wherein said engagement between said internal support means and said pallet member is in the form of male protuberances in one member and female indentations in the other member; such a pallet container wherein interior walls of pallet members are provided with female mating engagement elements and the interior support means is provided with male mating engagement elements for mating engagement therewith; such a pallet container comprising also end wall or divider means; such a pallet container comprising also variable and removable internal means for support or protection of a load being shipped; such a pallet container wherein the top and bottom pallet members have identical side configurations and the side pallet members have identical side configurations at their sides, the one configuration being male and the other configuration being female, thereby to provide a mating engagement joint at the container corners; such a pallet container wherein the bottom, top, and side pallet members of the pallet container have identical configurations at the opposite sides thereof which abut at each corner of the container, so as to provide identical mating engagement joints at the corners of the container; such a pallet container there being only two types of engagement means, which engagement means are identical at both sides of the same pallet member; and such a pallet container wherein the mating engagement means is the same for all pallet members at both sides thereof.

Moreover, a knockdown pallet container formed of molded or extruded pallet members, comprising a bottom-forming pallet member, and side and/or top pallet members, a combination of the bottom, side, and/or top pallet members providing a pallet container of polygonal configuration, at least the bottom-forming pallet member having entryways for insertion of the prongs of a lift truck, the polygonal pallet container being banded together by strapping which holds engaging means at sides of the various pallet members in mating engagement with each other where they meet to form corners of said container; such a pallet container wherein the sides of the pallet members are configured so as to provide complementary male and female engaging means; such a pallet container wherein the polygonal container has the cross-sectional configuration of a polygon having a maximum of four sides; such a pallet container wherein more than one pallet member has entryways for the prongs of a lift truck; such a pallet container wherein all pallet members have entryways for the prongs of a lift truck; and such a a pallet container comprising at least one end wall or divider mounted in slots or recesses in a plurality of the said pallet members.

Moreover, a pallet member adapted to produce, with additional identical or similar pallet members, a rectangular pallet container, having means at the sides thereof adapted for mating engagement with complementary means at the sides of identical or similar pallet members to form a joint at the corners of a rectangular pallet container formed therefrom; as well as a pallet member adapted to produce, with additional identical or similar pallet members, a polygonal pallet container, having means at the sides thereof adapted for mating engagement with complementary means at the sides of identical or similar pallet members to form a joint at the corners of a polygonal pallet container formed therefrom; such a pallet member wherein the means at one side of the pallet member has a female configuration and the means at the other side of the pallet member has a male configuration; and such a pallet member wherein the means at both sides of the pallet member has the same configuration.

BRIEF DESCRIPTION OF THE DRAWINGS

The invention will be better understood by reference to the drawings, wherein:

FIG. 1 is a partially-exploded and partially cut away isometric view of an extruded, injection-molded, or rotation-molded pallet container of the invention viewed from one end, e.g., the front or rear, with end walls or plates;

FIG. 2 is a partial interior side or face view, partially in cross-section, of a compression-formed pallet according to the invention illustrating two different ways of securing end walls or plates in a bottom-forming pallet;

FIG. 3 is an enlarged broken-away partial left-corner cross-sectional view of a structure of FIG. 2;

FIG. 4 is an enlarged broken-away partial right-corner cross-sectional view of a structure of FIG. 2;

FIG. 5 is a partial cross-sectional or end view of an extruded pallet with right and left end panels secured therein;

DETAILED DESCRIPTION OF PREFERRED EMBODIMENTS OF THE INVENTION

Figure 6:
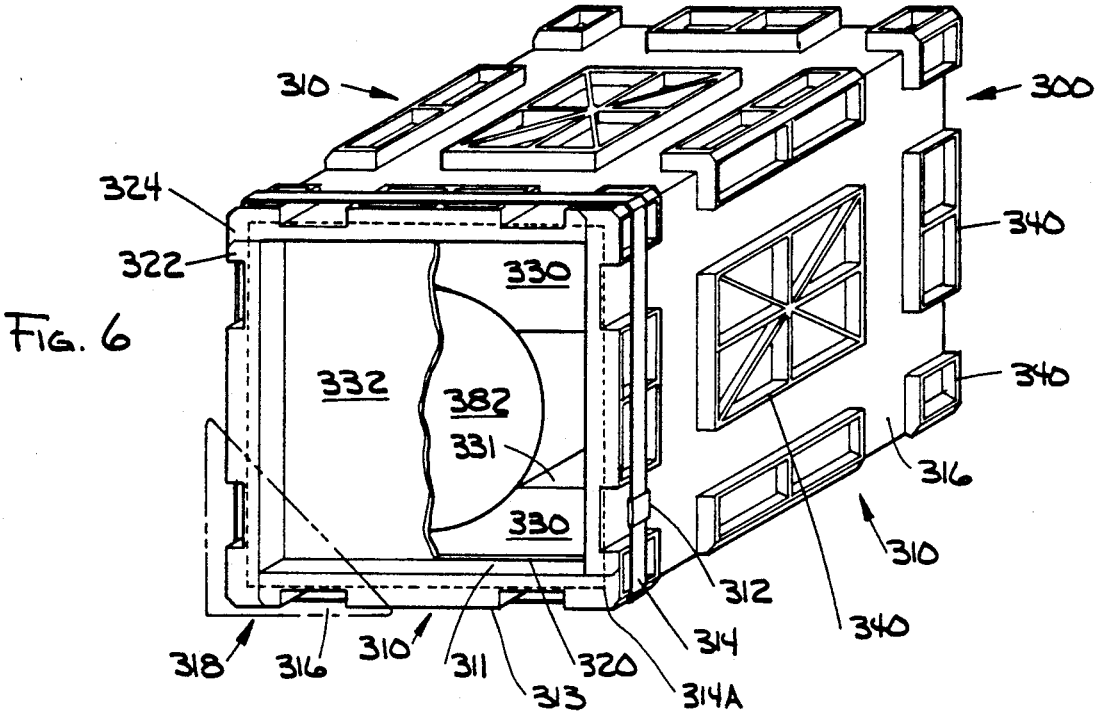
FIG. 6 is a partially broken-away isometric view of a pallet container of the invention assembled from compression-molded pallets.

Reference is now made to the accompanying drawings for a better understanding of the invention, in which all essential parts or elements are numbered and the same or similar numbers are employed to refer to the same or similar parts or elements throughout.

FIG. 1 shows an assembled container of the invention generally at 100. Pallet member 10 is the same on all four (4) sides of the container with the exception of the male section 22 of typical joint 18 at the ends of top and bottom pallet members 10 and the female portion 24 of typical joint 18 on the sides of the side pallet members 10 at the ends thereof. The entire assembly is secured, e.g., strapped or banded, together, and particularly the engaging means 22 and 24 on the ends and sides of the various pallet members 10 are held in mating engagement with each other where they meet to form joint 18 at the corners of the container, by suitable banding or strapping 14, of metal or plastic, such as steel or other metal strapping or Signode Dymax TM plastic strapping, which in turn is securely clamped to itself by clamping devices 12. Openings or apertures 16 for the prongs or tines of a forklift truck are provided on all pallet members on all sides of the container, as well as at the ends thereof. Slot 20 is provided in all pallet members to receive end pallet member 32 therein. Panel members 10 are provided with female interlocking device 28 which cooperates with male interlocking device 26 of interior formed shipping or support panel member 30 on all four sides, thus providing an interlock between the formed support panel member 30 interior of the pallet container of the invention and all four interior walls thereof. Moreover, panel member 30 is provided at its sides 31 with angles, e.g., 45° angles, for complementary mating with the side 31 of an adjacent panel member 30 where they meet at the corners of the container, thus providing further internal support to the container. Pallet member 10 has interior surfaces 11 and exterior surfaces 13, and the ends of the pallet container of the invention terminate in ends 15 of pallet members 10. In the embodiment of FIG. 1, the structural elements may be either extruded or compression formed, but are advantageously formed by extrusion.

In the compression-molded embodiment of FIG. 2, which illustrates two separate ways of securing end caps, walls, or panels in a pallet container of the invention, 110 is a bottom-forming pallet member, the same pallet configuration being used on all four sides of the container, with the exception of the male and female joints as illustrated in FIG. 1, and the interior surface thereof is indicated at 111, whereas the exterior surface thereof is indicated at 113. Openings 116 are provided for the insertion of forklift truck forks or tines. The end panel members are designated 132. Grooves or slots for receiving end panel members 132 are respectively designated 120 at the left-hand side of the drawing and 120A at the right-hand side of the drawing. A segment of formed shipping or support panel is seen at 30. An insert or retaining device 140, better seen in FIG. 4, is employed for securement of end panel member 132 within slot 120A at the right-hand side of FIG. 2.

FIG. 3 shows an enlarged view of the lower left-hand corner of the structure of FIG. 2, with end panel member 132 being press fit, glued, or otherwise secured in groove or slot 120 of bottom-forming pallet member 110.

FIG. 4 shows a method of securing end panel member 132 within slot or groove 120A of bottom pallet member 110 when using a retaining device 140. The assembly is generally shown at 144, the retaining device or insert 140 being press fit, glued, or otherwise secured in slot or groove 120A, and provided with points or hooks 141 for retention of end panel member 132 therein.

The partial cross-sectional end view of extruded pallet member 210 illustrated in FIG. 5 shows openings 216 for the prongs or tines of a forklift truck, whereas further openings 212 may be left unfilled or may be filled with particulate filler, plastic, or foam, or otherwise filled as desired, according to the application at hand and the requirements therefor. End panel members 232 are shown in apertures 220 provided in the extruded pallet member 210 into which end panel members 232 fit snugly and wherein they may be press fit, glued, or otherwise secured.

In the embodiment illustrated in FIG. 6, the pallet members are compression molded. The assembled container is shown at 300, the entire assembly being held together by strapping 314 secured to itself by clamps 312. When the strapping 314 is countersunk, as by provision of the necessary recesses on the exterior surfaces of the pallet members of the containers, the position or location of the strapping is shown in shadow lines. The container comprises upper, lower, and two side pallet members 310, all four pallet members being the same. The assembly comprises the typical assembled joint 318 where the pallet members meet to form corners of the container, formed by male portion 322 of the joint at the one side of the pallet member 310 and the female portion 324 of the joint formed at the side of the pallet member 310 at the other side thereof, these engaging means again being held together in mating engagement by external strapping 314. On the exterior surface 313 of each pallet member are provided apertures or openings 316 for the insertion therein of the prongs or tines of a forklift truck. Slot or groove 320 is provided in all pallet members 310 for reception therein of end panel member 332. Interior of the container are located top and bottom segments of formed shipping or support panel member 330, the bottom segment having an upper surface 331, and by means of which part 382 is firmly supported within the interior of the shipping container. Formed shipping or support panel members 330 may also be provided in configurations so that two panel members fill the container cross-section, or in four sections as in FIG. 1, or in any other suitable configuration. Exterior surfaces 313 of pallet members 310 comprise raised portions or protuberances 340 to prevent slippage of containers when a plurality of the same are positioned either next to or upon each other.

Figure 7:
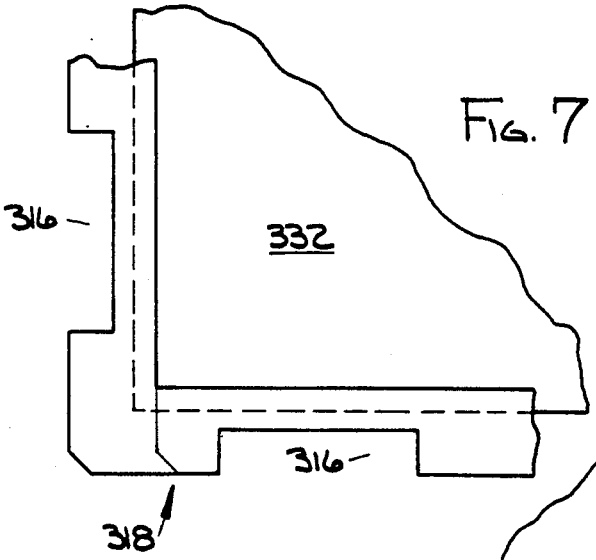
FIG. 7 is a partial view of the lower left-hand corner of the structure of FIG. 6, showing the end plate or wall in shadow lines in place in a recess in the bottom and left side pallets.

The typical assembled joint 318 is shown in greater detail in FIG. 7, from which the apertures or openings 316 for the insertion of the forks or tines of a forklift truck in exterior surface 313 are visible, along with typical assembled joint 318, with the end panel 332 in slot or groove 320 shown in shadow lines in FIG. 7.

Figure 8:
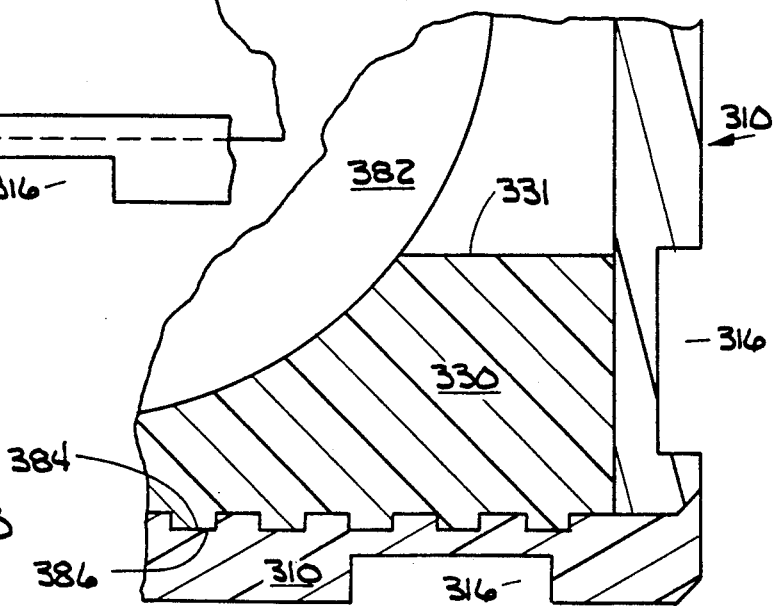
FIG. 8 is an enlarged partial sectional view of the structure of FIG. 6 at the lower right-hand corner thereof showing the cooperation between interior support panels and the container structure.

FIG. 8 shows a partial section of the container of FIG. 6 or FIG. 7, with pallet members 310 and apertures 316 clearly visible. Part 382 is supported interior of the container by lower segment of formed shipping or support panel member 330, having upper surface 331, there being only partial upper and lower support for part 382 in this embodiment, the support member 330 not extending all the way around part 382 as in other embodiments. In the embodiment of FIG. 8, male dovetails 384 are provided along the edges of formed shipping or support panel member 330 which cooperate with female dovetails 386 in the top surface of bottom-forming pallet member 310 to maintain the formed shipping or support panel member 330 securely in place and to keep the same from slipping and sliding during shipment of part 382.

Although the knockdown pallet container of the invention has been described primarily as having a rectangular configuration, it should be apparent to one skilled in the art that a pallet container of other than a rectangular configuration may also be employed. For example, the pallet container of the invention may take the shape of any suitable polygon, such as a triangle, especially an equilateral, isosceles, or right triangle, or any other suitable parallelogram or rectangle, such as a pentagon or hexagon, among which a rectangular configuration and especially a square configuration is preferred for greatest stability. The only limiting factor is that the pallet container of the invention must have a bottom-forming pallet member and a sufficient number of side pallet members, with or without a top pallet member, to complete the polygonal configuration. Although a rectangular configuration and particularly a square configuration is highly advantageous from the standpoint of innate stability, it will immediately be apparent to one skilled in the art that a triangular configuration can be employed with only somewhat lesser facility and with only somewhat lesser stability, and that other polygonal configurations may also be utilized, especially when appropriate stabilizing internal dividers or internal supports are provided therein, and preferably also when additional support is provided at the corners of the container, and that in certain instances a triangular cross-sectional configuration may be preferred, such as for the shipping of extremely elongated articles or the like. Nevertheless, a polygonal cross-sectional configuration with a maximum of four (4) sides is preferred in any event for maximum stability, simplicity, and facility of construction and erection. Accordingly, it should be apparent that the invention does not relate only to pallet containers of rectangular configuration, but that other suitable polygonal configurations may also be employed, as just enumerated in the foregoing.

From the foregoing, it is seen that the pallet container of the invention, in its various and variable embodiments and adaptations, is conveniently versatile and adaptable to the shipment of innumerable objects with equal facility, and that the precise interior structure of a pallet container of the invention can be varied at will to suit the needs of even the most demanding and discriminating shippers.

It is accordingly seen from the foregoing that the present invention provides a highly desirable and advantageous pallet container or shipping container embodying pallet features, which comprises a bottom load-supporting pallet and side walls, together constituting a pallet container, and if desired end caps, walls, or plates, which is suitable for the shipment of innumerable types of materials and products therein and, at the same time, a unique load-supporting pallet which may be separated from the other pallet container members which may be knocked-down for return to the place of origin, while the basic or bottomforming or load-supporting pallet member may either accompany them back to the point of origin or continue to serve as a load-supporting pallet for the continued support of whatever load, material, or product was originally shipped thereon, all having the foregoing characteristics and advantages as previously enumerated.

It is to be understood that the present invention is not to be limited to the exact materials, structures, procedures, or arrangements disclosed, as numerous modifications and changes therein will immediately become apparent to one skilled in the art to which this invention pertains, wherefore the present invention is to be understood as limited only by the full scope which can be legally accorded to the appended claims.

I claim:

1. A knockdown pallet container formed of molded or extruded pallet members, comprising a bottom-forming pallet member, a top pallet member, and side pallet members, a combination of the bottom, side, and top pallet members providing a pallet container of rectangular configuration, the top, side and bottom-forming pallet members all having entryways for the prongs of a lift truck, the rectangular pallet container being banded together by external strapping which holds mating engagement means at sides of the various pallet members in mating engagement with each other where they meet to form corners of said container, said mating engagement means being present along the entire length of the sides of the pallet members where they meet to form the four side corners of the rectangular container and being adapted to form a continuous mated engagement joint along the four side corners of the rectangular pallet container formed therefrom.

2. A pallet container of claim 1, wherein the sides of the pallet members are configured so as to provide complementary male and female mating engagement means.

3. A pallet container of claim 1, wherein the ends or sides of the pallet members are configured so as to provide male and female interlocks.

4. A pallet container of claim 1, wherein the pallet container comprises a top, bottom, sides, and a front and rear, and wherein the bottom-forming pallet member has entryways for the prongs of a lift truck at both its front and rear.

5. A pallet container of claim 1, wherein internal support means are provided for supporting a load interior of said pallet container.

6. A pallet container of claim 5, wherein the internal support means are provided with engaging means adapted to mate with complementary engaging means provided on pallet members interior of the pallet container.

7. A pallet container of claim 6, wherein the engaging means comprises a male protuberance on the internal support means and a female depression on a surface of a pallet member interior of the container.

8. A pallet container of claim 6, wherein said engagement between said internal support means and said pallet member is in the form of male protuberances in one member and female indentations in the other member.

9. A pallet container of claim 5, wherein the internal support means is provided in the form of sections adapted to mate with each other at corners of the pallet container.

10. A pallet container of claim 9, wherein sections of the internal support means are adapted to lie against interior surfaces of the pallet container and to mate with each other at interior corners of the pallet container.

11. A pallet container of claim 10, wherein the internal support means are angled at edges adapted to mate at corners of the pallet container so as to provide mating abutment thereof at junctures thereof internal of said pallet container and at interior corners thereof.

12. A pallet container of claim 5, wherein said internal support means comprises mating engagement means adapted to mate with complementary mating engagement means provided in a pallet member against which said support means abuts, and complementary mating engagement means in said pallet member.

13. A pallet container of claim 12, wherein interior walls of pallet members are provided with female mating engagement elements and the internal support means is provided with male mating engagement elements for mating engagement therewith.

14. A pallet container of claim 1, comprising end wall means for providing a wall at an end of said container.

15. A pallet container of claim 14, comprising also securing means for securing said end wall means with respect to a pallet member of said container.

16. A pallet container of claim 15, wherein said securing means comprises slots or recesses in a plurality of pallet members of said container adapted to receive said wall means.

17. A pallet container of claim 16, wherein said securing means also comprises adapter or socket means for securement of said end wall means in said slot in said pallet member.

18. A pallet container of claim 14, wherein the pallet container comprises a top, bottom, sides, and a front and rear, and comprising end walls at both the front and rear thereof.

19. A pallet container of claim 1, comprising also preformed internal support means adapted to protect a load being transported therein.

20. A pallet container of claim 1, comprising contoured external surfaces adapted to cooperate with similar external surfaces of abutting pallet containers of the same type, thereby to prevent excessive relative movement between abutting pallet containers during transportation thereof.

21. A pallet container of claim 1, wherein the pallet container comprises a top, bottom, sides front and rear, and wherein the bottom-forming pallet member comprises entryways for the insertion of prongs of a forklift therein from both the front and rear and from a side.

22. A pallet container of claim 21, comprising also end wall means.

23. A pallet container of claim 1, wherein the pallet container comprises a top, bottom, sides, front and rear, and wherein all of the top, bottom, and side pallet members comprise entryways for the insertion of prongs of a forklift from a side.

24. A pallet container of claim 23, wherein said entryways are provided in the form of depressions in the external surface of a pallet member.

25. A pallet container of claim 24, wherein said entryways are provided in the form of suitable indentations in a molded external surface of a pallet member.

26. A pallet container of claim 23, wherein said entryways are provided in the form of apertures into the pallet member itself.

27. A pallet container of claim 1, wherein internal support members abut interior surfaces of all four pallet members and all internal support members are angled at their edges for mating abutment at the corners of the container, thereby not only to provide abutment of said interior support members but also to add structural support at the corners of said container.

28. A pallet container of claim 1, comprising also variable and removable internal means for support or protection of a load being shipped.

29. A pallet container of claim 1, wherein the top and bottom pallet members have identical side configurations and the side panels have identical side configurations, the one configuration being male and the other configuration being female, thereby to provide a mating engagement joint at the container corners.

30. A pallet container of claim 29, there being only two types of engagement means, which engagement means are identical at both sides of the same pallet member.

31. A pallet container of claim 1, wherein the bottom, top, and side pallet members of the pallet container have identical configurations at the opposite sides thereof which abut at each corner of the container, so as to provide identical mating engagement joints at the corners of the container.

32. A pallet container of claim 31, wherein the mating engagement means is the same for all pallet members at both sides thereof.

33. A knockdown pallet container formed of molded or extruded pallet members, comprising a bottom-forming pallet member, and additional pallet members, a combination of the bottom, and additional pallet members providing a pallet container of polygonal configuration, all said pallet members having entryways for insertion of the prongs of a lift truck, the rectangular pallet container being banded together by strapping which holds mating engagement means at sides of the various pallet members in mating engagement with each other where they meet to form corners of said container, said mating engagement means being present along the entire length of the sides of the pallet members where they meet to form the corners of the container and being adapted to form a continuous joint along the corners of pallet container formed therefrom.

34. A pallet container of claim 33, wherein the sides of the pallet members are configured so as to provide complementary male and female mating engagement means.

35. A pallet container of claim 34, wherein the polygonal container has a cross-sectional configuration of a polygon having a maximum of four sides.

36. A pallet container of claim 33 comprising at least one end wall mounted in slots or recesses in a plurality of the said pallet members.

37. A plurality of rectangular pallet members adapted to produce, a pallet container, each pallet member having mating engagement means along the full length of two sides thereof adapted for mating engagement with complementary mating engagement means along the full length of a side of two other of said pallet members, said mating engagement means along said two sides of each pallet member being continuous whereby said pallet members are adapted to form a continuous mating engagement joint at the four side corners of a rectangular pallet container produced therefrom, all of said pallet members having entryways for the prongs of a lift truck.

38. The pallet members of claim 37, wherein the mating engagement means at one side of each pallet member has a female configuration and the mating engagement means at the other side of each pallet member has a male configuration.

39. The pallet members of claim 37, wherein the mating engagement means at both said sides of each pallet member has the same configuration.

40. A plurality of rectangular pallet members adapted to produce a pallet container, each pallet member having mating engagement means along the full length of two sides thereof adapted for mating engagement with complementary mating engagement means along the full length of a side of two other of said pallet members, said mating engagement means along said two sides of each pallet member being continuous, whereby said pallet members are adapted to form a continuous joint at the corners of a polygonal pallet container formed therefrom, all of said pallet members having entryways for the prongs of a lift truck.

41. The pallet members of claim 40, wherein the mating engagement means at one side of each pallet member has a female configuration and the mating engagement means at the other side of each pallet member has a male configuration.

42. The pallet members of claim 40, wherein the mating engagement means at both said sides of each pallet member has the same configuration.

43. A knockdown pallet container formed of molded or extruded pallet members, comprising a bottom-forming pallet member, a top pallet member, and side pallet members, a combination of the bottom, side, and top pallet members providing a pallet container of rectangular configuration, the rectangular pallet container being banded together by external strapping which holds mating engaging means at sides of the various pallet members in mating engagement with each other where they meet to form corners of said container, wherein the pallet container has a top, bottom, and sides, and wherein all of the bottom, top, and side pallet members comprise entryways for the entry of prongs of a forklift.

44. A pallet container of claim 43, wherein the pallet container has a top, bottom, sides, front, and rear, and wherein at least the bottom-forming pallet member comprises entryways for the insertion of prongs of a forklift from the front and rear.

45. A pallet container of claim 43, wherein entryways for the entry of prongs of a forklift from the side are provided on all four of the bottom, top, and side pallet members, thereby to allow entry of prongs of a forklift from the side regardless of the member upon which the pallet container is resting.

46. A pallet container of claim 43, wherein the rectangular container has a cross-sectional configuration of a polygon having four sides.

47. A knockdown pallet container formed of molded or extruded pallet members, comprising a bottom-forming pallet member, and additional pallet members, a combination of the bottom, and additional pallet members providing a pallet container of polygonal configuration, the polygonal pallet container being banded together by strapping which holds mating engagement means at sides of the various pallet members in mating engagement with each other where they meet to form corners of said container, wherein all pallet members have entryways for the prongs of a forklift.

48. A pallet container of claim 47, comprising at least one end wall mounted in slots or recesses in a plurality of the said pallet members.

49. A pallet container of claim 47, wherein the sides of the pallet members are configured so as to provide complementary male and female mating engagement means.

50. A pallet container of claim 47, wherein the polygonal container has a cross-sectional configuration of a polygon having a maximum of four sides.

* * * * *

UNITED STATES PATENT AND TRADEMARK OFFICE

CERTIFICATE OF CORRECTION

PATENT NO. : 5,031,776

DATED : July 16, 1991

INVENTOR(S) : Robert L. Morgan, IV

It is certified that error appears in the above-identified patent and that said Letters Patent is hereby corrected as shown below:

Title Page, [56] References Cited, U.S. PATENT DOCUMENTS, second column, last listing; "Beek" should read --Beck--.

Column 12, line 62; "rectangular" should read --polygonal--.

Signed and Sealed this

Thirteenth Day of April, 1993

*Attest:*

STEPHEN G. KUNIN

*Attesting Officer*

*Acting Commissioner of Patents and Trademarks*